US010669812B2

(12) United States Patent
Green et al.

(10) Patent No.: US 10,669,812 B2
(45) Date of Patent: Jun. 2, 2020

(54) MAGNETIC SLEEVE CONTROL VALVE FOR HIGH TEMPERATURE DRILLING APPLICATIONS

(71) Applicants: Ryan Damont Green, League City, TX (US); Sebastian Tegeler, Hannover (DE); Andreas Peter, Cello (DE)

(72) Inventors: Ryan Damont Green, League City, TX (US); Sebastian Tegeler, Hannover (DE); Andreas Peter, Cello (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 169 days.

(21) Appl. No.: 15/066,389

(22) Filed: Mar. 10, 2016

(65) Prior Publication Data

US 2017/0260832 A1 Sep. 14, 2017

(51) Int. Cl.
*E21B 34/06* (2006.01)
*E21B 47/18* (2012.01)

(52) U.S. Cl.
CPC ..... *E21B 34/066* (2013.01); *E21B 47/18* (2013.01)

(58) Field of Classification Search
CPC ..... E21B 34/12; E21B 34/066; E21B 47/18; E21B 2034/007
See application file for complete search history.

(56) References Cited

U.S. PATENT DOCUMENTS 2,278,532 A * 4/1942 Crickmer ..... E21B 34/066 137/155
3,065,416 A 11/1962 Jeter
3,523,676 A 8/1970 Barker
3,958,217 A 5/1976 Spinnler
3,964,556 A 6/1976 Gearhart
4,078,620 A 5/1978 Westlake
4,336,564 A 6/1982 Wisniewski et al.
4,351,037 A 9/1982 Scherbatskoy
4,386,422 A 5/1983 Mumby
4,515,225 A 5/1985 Dailey
(Continued)

FOREIGN PATENT DOCUMENTS

EP 0088402 A2 9/1983
JP 2003097756 A 4/2003
(Continued)

OTHER PUBLICATIONS

Notification of Transmittal of the International Search Report and the Written Opinion of the International Searching Authority, or the Declaration; PCT/US2017/021327; dated May 10, 2017; 15 pages.
(Continued)

*Primary Examiner* — Waseem Moorad
*Assistant Examiner* — Neel Girish Patel
(74) *Attorney, Agent, or Firm* — Cantor Colburn LLP

(57) ABSTRACT

A control valve assembly includes a body having a mud flow passage provided with a mud flow inlet and a mud flow outlet, a magnetic sleeve slidingly mounted to the body, and a solenoid mounted to the body adjacent the magnetic sleeve. The solenoid being selectively activated to shift the magnetic sleeve between a first position covering the mud flow outlet and a second position exposing the mud flow outlet allowing a pulse of mud to flow through the mud flow passage.

22 Claims, 4 Drawing Sheets

(56) References Cited

U.S. PATENT DOCUMENTS 4,550,392 A 10/1985 Mumby
4,628,495 A 12/1986 Peppers
4,719,979 A 1/1988 Jones
4,819,745 A 4/1989 Walter
4,825,421 A 4/1989 Jeter
4,873,488 A 10/1989 Barber et al.
5,070,595 A * 12/1991 Perkins ..... E21B 34/066 166/66.7
5,073,877 A * 12/1991 Jeter ..... E21B 47/18 367/84
5,103,430 A 4/1992 Jeter et al.
5,182,731 A 1/1993 Hoelscher
5,275,337 A 1/1994 Kolarik et al.
5,303,776 A 4/1994 Ryan
5,333,686 A 8/1994 Vaughan
5,660,238 A 8/1997 Earl
6,002,643 A 12/1999 Tchakarov
6,016,288 A * 1/2000 Frith ..... E21B 47/187 181/102
6,199,823 B1 * 3/2001 Dahlgren ..... F16K 31/0651 251/117
6,328,112 B1 12/2001 Malone
6,464,011 B2 10/2002 Tubel
6,555,926 B2 4/2003 Gondron
6,626,244 B2 * 9/2003 Powers ..... E21B 17/003 166/242.7
6,714,138 B1 3/2004 Turner
6,811,135 B2 * 11/2004 Moreno ..... F16K 31/0648 251/129.02
6,898,150 B2 5/2005 Hahn
7,350,588 B2 * 4/2008 Abercrombie Simpson ..... E21B 43/103 166/208
7,921,876 B2 4/2011 Wright et al.
8,365,821 B2 2/2013 Hall et al.
8,469,104 B2 6/2013 Downton
8,534,381 B1 9/2013 Rinald
8,627,883 B2 1/2014 Richards
8,627,893 B2 1/2014 Otto et al.
8,640,768 B2 2/2014 Hall et al.
8,672,025 B2 3/2014 Wolf et al.
8,905,075 B2 12/2014 Tower
8,912,915 B2 12/2014 Hay et al.
2002/0117644 A1 8/2002 Carrillo et al.
2003/0024706 A1 * 2/2003 Allamon ..... E21B 21/103 166/373
2003/0047317 A1 3/2003 Powers
2004/0069530 A1 4/2004 Prain
2007/0056771 A1 3/2007 Gopalan et al.
2008/0236841 A1 * 10/2008 Howlett ..... E21B 17/05 166/381
2008/0236842 A1 10/2008 Bhavsar et al.
2009/0009174 A1 1/2009 Forgang et al.
2009/0114396 A1 5/2009 Kusko et al.
2010/0089587 A1 * 4/2010 Stout ..... E21B 23/04 166/319
2010/0102264 A1 4/2010 Bickoff et al.
2010/0195442 A1 8/2010 Reyes et al.
2011/0155392 A1 * 6/2011 Frazier ..... E21B 34/06 166/373
2011/0232791 A1 * 9/2011 Bengea ..... F16K 31/0613 137/625.64
2011/0278017 A1 * 11/2011 Themig ..... E21B 34/14 166/373
2012/0118582 A1 * 5/2012 Soni ..... E21B 34/14 166/374
2012/0261603 A1 10/2012 Kahn et al.
2012/0279723 A1 11/2012 Hofman
2014/0034325 A1 * 2/2014 Jancha ..... E21B 34/10 166/321
2014/0284112 A1 * 9/2014 Cenac ..... E21B 21/10 175/317
2014/0332277 A1 11/2014 Churchill
2015/0034386 A1 2/2015 Reed et al.
2015/0107902 A1 * 4/2015 Downton ..... E21B 7/062 175/45
2015/0260014 A1 * 9/2015 Zimmerman ..... E21B 41/0085 166/373
2015/0322753 A1 11/2015 Zimmerman, Jr.
2016/0265350 A1 9/2016 Brown-Kerr et al.
2016/0341001 A1 * 11/2016 Scholz ..... E21B 47/185
2016/0369596 A1 * 12/2016 McMillon ..... E21B 23/00
2017/0260831 A1 9/2017 Green
2017/0260852 A1 9/2017 Green et al.

FOREIGN PATENT DOCUMENTS

WO 2014094150 A1 6/2014
WO 2015017522 A1 2/2015

OTHER PUBLICATIONS

Notification of Transmittal of the International Search Report and the Written Opinion of the International Searching Authority, or the Declaration; PCT/US2017/021329; dated May 10, 2017; 12 pages.
Notification of Transmittal of the International Search Report and the Written Opinion of the International Searching Authority, or the Declaration; PCT/US2017/021331; dated May 31, 2017; 13 pages.
Schlumberger, "High Temperature Drilling Operations", Retrieved from: https://www.slb.com/~/media/Files/drilling/brochures/drilling_applications/ht_tools_br.pdf; "An Industry Challenge" In 1-9: High temperatures can cause severe damage . . . .

* cited by examiner

MAGNETIC SLEEVE CONTROL VALVE FOR HIGH TEMPERATURE DRILLING APPLICATIONS

BACKGROUND

Downhole operations often include a downhole string that extends from an uphole system into a formation. The uphole system may include a platform, pumps, and other systems that support resource exploration, development, and extraction. In some instances, fluids may be passed from the uphole system into the formation through the downhole string. In other instances, fluid may pass from the formation through the downhole string to the uphole system. The downhole string may include various sensors that detect downhole parameters including formation parameters and parameters associated with the downhole string.

It is desirable to communicate information from downhole sensors to the uphole system. Communication may take place through wired, optical, or acoustical systems. Acoustical systems rely upon passage of pressure pulses generated downhole to an uphole receiver. The pressure pulses are created by moving a piston through a hydraulic fluid. The uphole receiver converts the pressure pulses to data indicative of sensed parameters. The pressure pulses provide useful information to uphole operators. Therefore, advances in downhole communication systems would be well received by resource exploration and recovery companies.

SUMMARY

A control valve assembly includes a body having a mud flow passage provided with a mud flow inlet and a mud flow outlet, a magnetic sleeve slidingly mounted to the body, and a solenoid mounted to the body adjacent the magnetic sleeve. The solenoid being selectively activated to shift the magnetic sleeve between a first position covering the mud flow outlet and a second position exposing the mud flow outlet allowing a pulse of mud to flow through the mud flow passage.

A resource exploration system includes an uphole system, and a downhole system including a downhole string operatively connected to the uphole system. The downhole string includes a pulser alternator generator having a main valve assembly, an alternator, and a control valve assembly operatively connected to the main valve assembly and the alternator. The control valve assembly includes a body having a mud flow passage provided with a mud flow inlet fluidically connected to the main valve assembly and a mud flow outlet, a magnetic sleeve slidingly mounted to the body, and a solenoid mounted to the body adjacent the magnetic sleeve. The solenoid is selectively activated to shift the magnetic sleeve between a first position covering the mud flow outlet and a second position exposing the mud flow outlet allowing a pulse of mud to flow through the mud flow passage.

BRIEF DESCRIPTION OF THE DRAWINGS

Referring now to the drawings wherein like elements are numbered alike in the several Figures.

DETAILED DESCRIPTION

Figure 1:
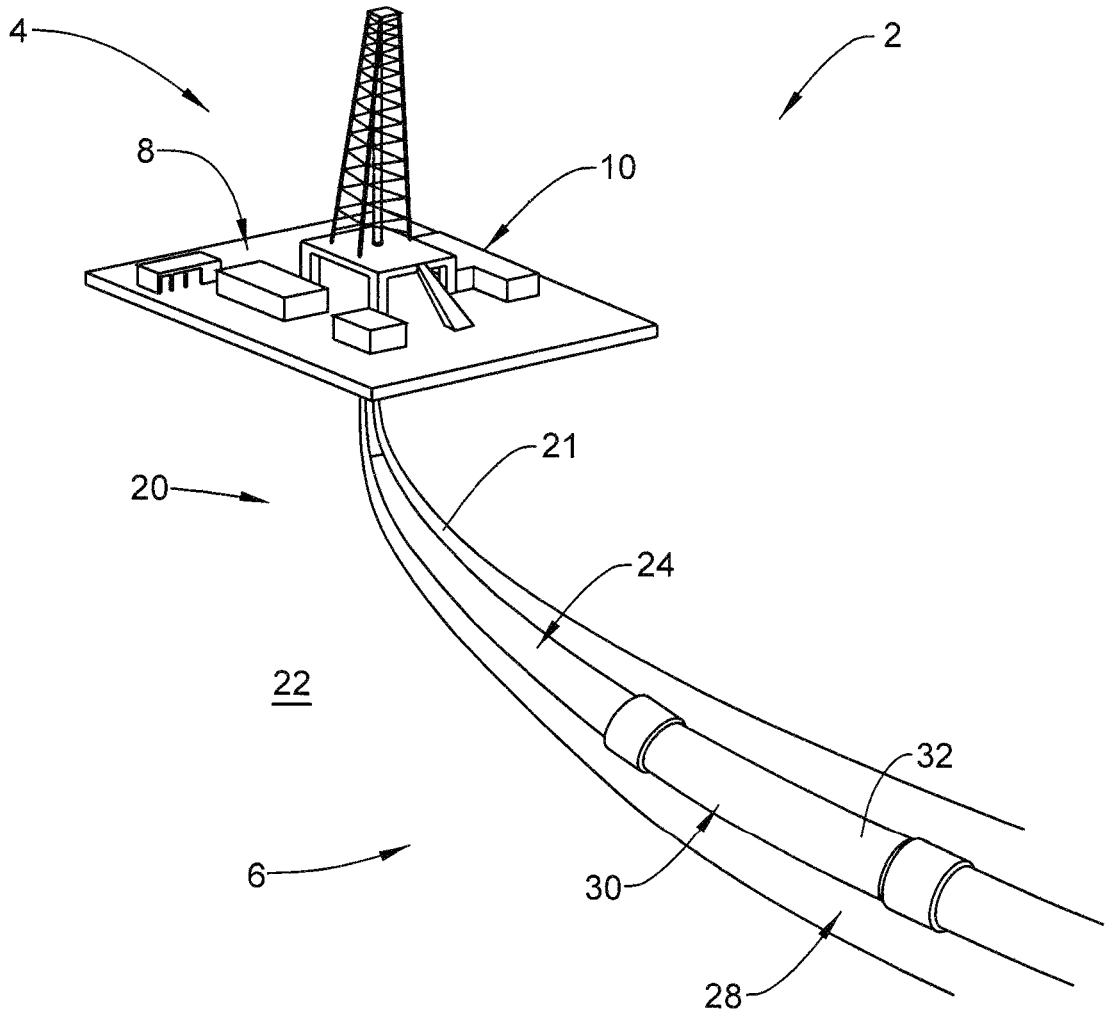
FIG. 1 depicts a resource exploration system having an uphole system operatively connected to a downhole string including a pulser alternator generator (PAG) having a magnetic sleeve control valve assembly, in accordance with an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include an uphole system 4 operatively connected to a downhole system 6. Uphole system 4 may include pumps 8 that aid in completion and/or extraction processes as well as fluid storage 10. Fluid storage 10 may contain a gravel pack fluid or slurry (not shown) that is introduced into downhole system 6.

Downhole system 6 may include a downhole string 20 that is extended into a wellbore 21 formed in formation 22. Downhole string 20 may include a number of connected downhole tools or tubulars 24. One of tubulars 24 may include a pulser alternator generator (PAG) assembly 28. PAG assembly 28 may receive signals from one or more sensors (not shown) indicating one or more of formation parameters, downhole fluid parameters, tool condition parameters and the like. PAG assembly 28 creates one or more pressure pulses that are received at uphole system 4. The one or more pressure pulses define a code that may contain information regarding data received by the sensors. In accordance with an exemplary embodiment, PAG assembly 28 creates pressure pulses by selectively stopping a flow of pressurized downhole fluid or mud as will be detailed more fully below.

Figure 2:
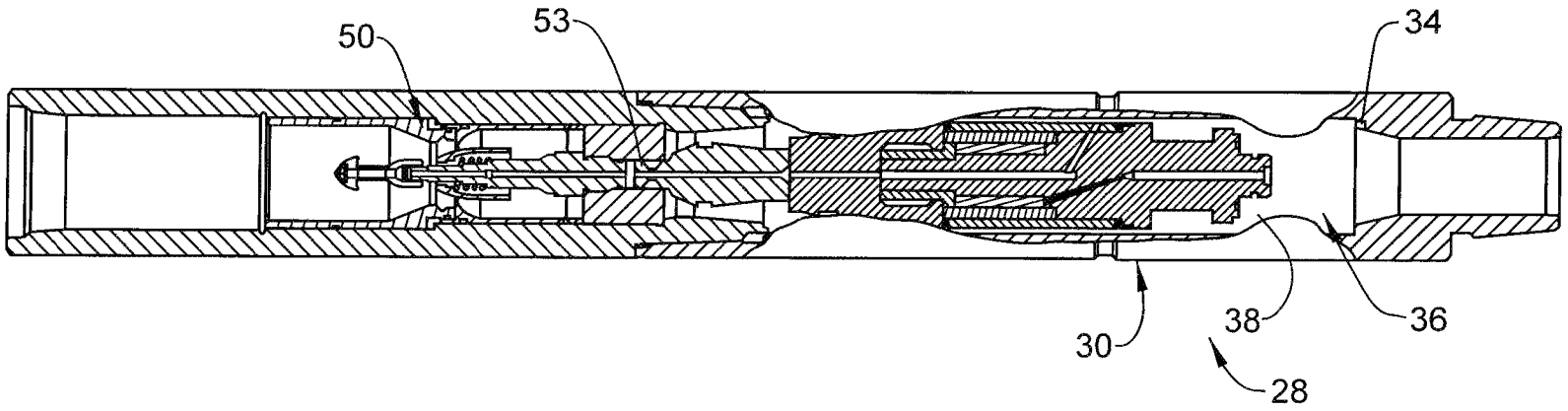
FIG. 2 depicts a partial cross-sectional view of the PAG of FIG. 1.

In accordance with an exemplary embodiment illustrated in FIG. 2, PAG assembly 28 includes a body portion 30 having an outer surface portion 32 and an inner portion 34. An inner housing 36 is arranged within inner portion 34. Inner housing 36 includes an outer surface 38 and an inner surface 40 that defines an interior portion 42. Interior portion 42 houses an alternator assembly 46, a control valve assembly (CVA) 48, and a main valve assembly (MVA) 50 having a mud flow inlet portion (not separately labeled) and a mud flow outlet portion (also not separately labeled). As will be detailed more fully below, alternator assembly 46 provides signals to CVA 48 that allow drilling mud to flow through MVA 50. CVA 48 creates pressure pulses in the mud flow that provide downhole data from sensors (not shown) operatively coupled to alternator assembly 46 to uphole operators.

Figure 3:
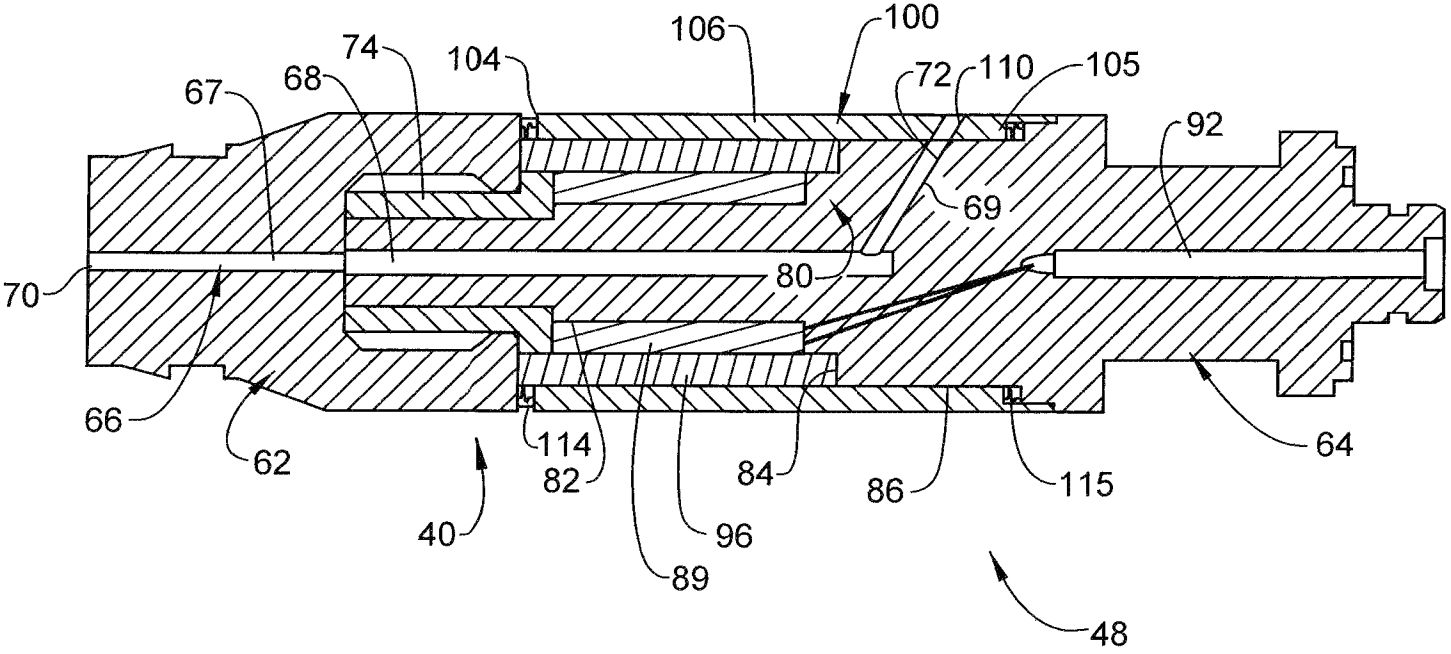
FIG. 3 depicts a magnetic sleeve control valve assembly, in accordance with an aspect of an exemplary embodiment.

As shown in FIG. 3, CVA 48 includes a body 60 including a first body portion 62 and a second body portion 64. A mud flow passage 66 extends through body portion 62. In the exemplary embodiment shown, mud flow passage 66 includes a first passage portion 67 that extends through first body portion 62, a second passage portion 68, and a third passage portion 69 both of which extend through second body portion 64. Third passage portion 69 may extend at an angle relative to a longitudinal axis (not separately labeled) of CVA 48.

In accordance with an aspect of an exemplary embodiment, third passage portion 69 may extend at an angle of between about 20° and about 80° relative to a longitudinal axis (not separately labeled) of CVA 48. In accordance with another aspect, third passage portion 69 may extend at an angle of about 60° relative to the longitudinal axis. In this manner, impact forces associated with pulses of mud passing from third passage portion onto inner surface 40 may be reduced over those which would be realized if third passage portion 69 were perpendicular to the longitudinal axis. Mud flow passage 66 includes a mud flow inlet 70 arranged in first body portion 62 and a mud flow outlet 72 provided in second body portion 64. Mud flow inlet is fluidically connected with first passage portion 67 and mud flow outlet 72 is fluidically connected with third passage portion 69. First body portion 62 is joined to second body portion 64 through a pressure sleeve 74 that facilitates alignment of first passage portion 67 with second passage portion 68.

In still further accordance with an exemplary embodiment, second body portion 64 includes an annular recessed portion 80 having a first section 82, a second section 84 and a third section 86. A solenoid 89 is positioned at first section 82 of recessed portion 80. Solenoid is operatively coupled to alternator assembly 46 through a conductor (not shown) extending through a conductor passage 92. A pressure sleeve member 96 is provided in second section 84 of annular recessed portion 80. Pressure sleeve member 96 extends about and protects solenoid 89 from downhole fluids.

In yet still further accordance with an exemplary aspect, CVA 48 includes a magnetic sleeve 100 slideably arranged in third section 86 of annular recessed portion 80. Magnetic sleeve 100 includes a first end portion 104, a second end portion 105 and a blocking portion 106 extending therebetween. Blocking portion 106 includes an opening 110 that selectively registers with mud flow outlet 72. A first spring 114 is arranged between first end portion 104 and an inner surface (not separately labeled) of third section 86. A second spring 115 is arranged between second end portion 105 and another inner surface (also not separately labeled) of third section 86. First and second springs 114 and 115 cooperate to maintain magnetic sleeve 100 in a first position wherein blocking portion 106 covers mud flow outlet 72.

With this arrangement, alternator assembly 46 provides signals to selectively activate solenoid 89 which, in turn, selectively shifts magnetic sleeve 100 from the first position to a second position (FIG. 3), wherein mud flow outlet 72 registers with opening 110. In the second position, mud may flow through mud flow outlet 72. When operated rapidly, pulses of mud pass from mud flow outlet 72 and contact inner surface 40 of inner housing 36. An uphole receiver captures pressure waves created by the pulses of mud. The pressure pulses are presented in a pattern dictated by signals received from one or more sensors at alternator assembly 46. The pressure pulses may be decrypted to provide data regarding one or more downhole parameters to uphole operators.

In accordance with an aspect of an exemplary embodiment, magnetic sleeve 100 is formed from 9Cr. In accordance with another aspect of an exemplary embodiment, magnetic sleeve 100 is formed from diamond coated 9Cr. In this manner, magnetic sleeve 100 may withstand corrosive properties of downhole fluids such as downhole mud. In further accordance with an aspect of an exemplary embodiment, first and second body portions 62 and 63 as well as pressure sleeve 74 are formed from 9Cr. Pressure sleeve member 96 is formed from NiO3. The particular materials are chosen to provide corrosion resistance to downhole fluids. Other materials that may also resist corrosion may also be employed.

Figure 4:
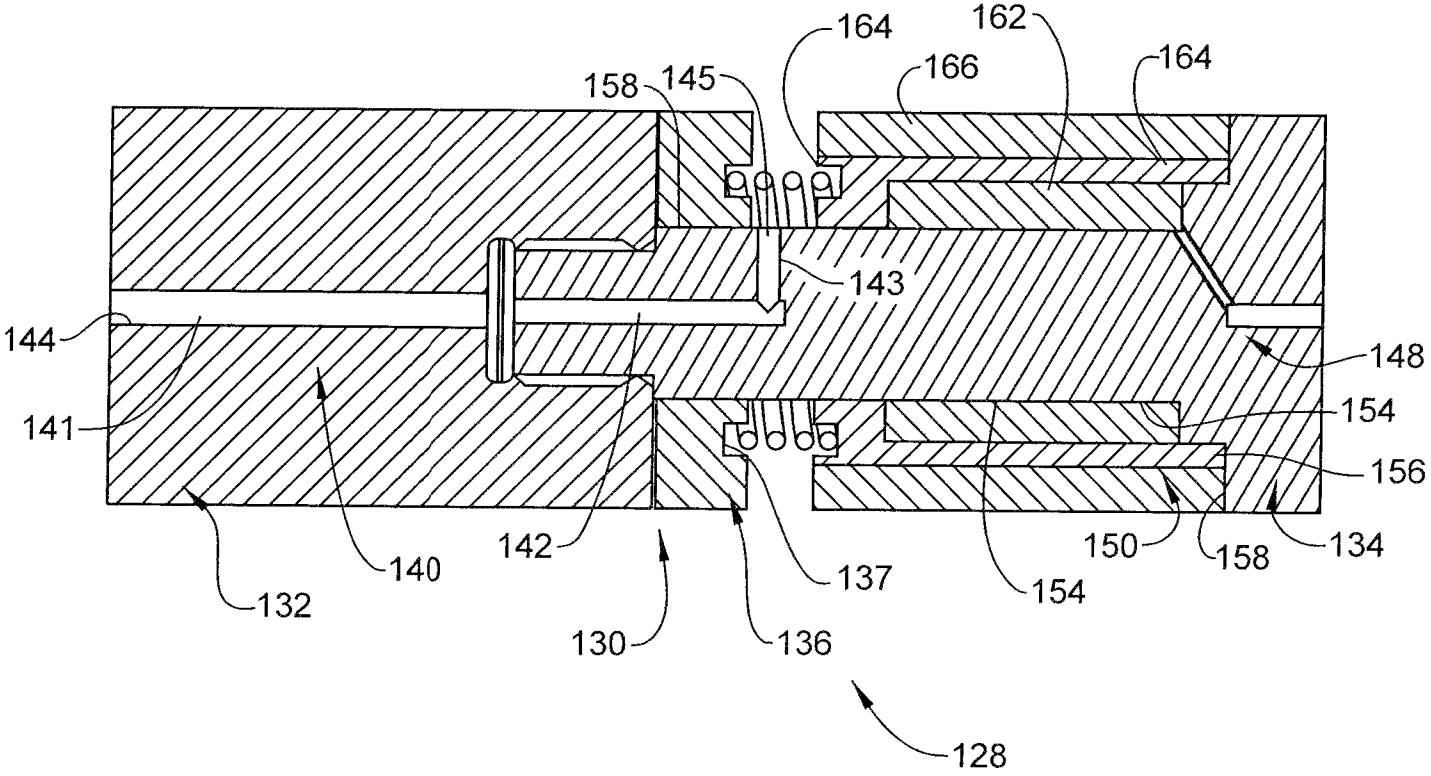
FIG. 4 depicts a magnetic sleeve control valve assembly, in accordance with another aspect of an exemplary embodiment.

Reference will now follow to FIG. 4 in describing a CVA 128 in accordance with another aspect of an exemplary embodiment. CVA 128 includes a body 130 having a first body portion 132 that is mechanically linked to a second body portion 134. First body portion 132 may be formed from NiO3 and second body portion 134 may be formed from 9Cr. A plate member 136 is arranged between first and second body portions 132 and 134. Plate member 136 may be formed from 9Cr and includes an annular recess 137. A mudflow passage 140 extends through body 140. Mudflow passage 140 includes a first passage portion 141 extending through first body portion 132 and a second passage portion 142 extending through second body portion 134. A third passage portion 143 extends substantially perpendicularly from second passage portion 142. Mudflow passage 140 includes a mudflow inlet 144 fluidically connected to first passage portion 141 and a mudflow outlet 145 fluidically connected to third passage portion 143. Second body portion 134 also includes a conductor passage 148 extending therethrough.

In accordance with an aspect of an exemplary embodiment, second body portion 134 also includes an annular recessed portion 150 having a first section 154, a second section 156 and a third section 158. A solenoid 162 is arranged in first section 154 of annular recessed portion 150. Solenoid 162 is electrically connected to alternator assembly 46 via a conductor (not shown) extending through conductor passage 148. A pressure sleeve 164 is arranged in second section 156 of annular recessed portion 150. Pressure sleeve 164 extends about and provides protection for solenoid 163. Pressure sleeve 164 is, in accordance with an aspect of an exemplary embodiment, is formed from NiO3 and includes an annular recess 165.

In further accordance with an aspect of an exemplary embodiment, CVA 128 includes a magnetic sleeve 166 arranged in third section 158 of annular recessed portion 150. Magnetic sleeve 166 is mechanically linked with pressure sleeve 164 and may be formed from 9Cr. Magnetic sleeve 166, together with pressure sleeve 164 are selectively shiftable between a first position (not shown) wherein mudflow outlet 145 is closed and a second position (FIG. 4) wherein mudflow outlet is exposed. A return spring 170 biases magnetic sleeve 166 pressure sleeve 164 in the second position. Return spring 170 nests within first and second annular recesses 137 and 165.

With this arrangement, alternator assembly 46 provides signals to selectively activate solenoid 162 which, in turn, shifts magnetic sleeve 166 from the first position to the second position. In the second position, mud may flow through mud flow outlet 145. When operated rapidly, pulses of mud pass from mud flow outlet 145 and contact inner surface 40 of inner housing 36. An uphole receiver captures pressure waves created by the pulses of mud. The pressure pulses are presented in a pattern dictated by signals received from one or more sensors at alternator assembly 46. The pressure pulses may be decrypted to provide data regarding one or more downhole parameters to uphole operators.

Set forth below are some embodiments of the foregoing disclosure:

Embodiment 1

A control valve assembly comprising: a body including a mud flow passage having a mud flow inlet and a mud flow outlet; a magnetic sleeve slidingly mounted to the body; and a solenoid mounted to the body adjacent the magnetic sleeve, the solenoid being selectively activated to shift the magnetic sleeve between a first position covering the mud flow outlet and a second position exposing the mud flow outlet allowing a pulse of mud to flow through the mud flow passage.

Embodiment 2

The control valve assembly according to claim 1, wherein the magnetic sleeve includes an opening that selectively registers with the mud flow outlet in the second position.

Embodiment 3

The control valve assembly according to claim 1, wherein the body includes a magnetic sleeve receiving recess including at least one wall portion, the magnetic sleeve including a first end portion, a second end portion and a blocking portion nesting within the magnetic sleeve receiving recess.

Embodiment 4

The control valve assembly according to claim 3, further comprising: a spring arranged between the at least one wall portion and one of the first and second end portions of the magnetic sleeve.

Embodiment 5

The control valve assembly according to claim 3, wherein the body includes a first body portion operatively coupled to a second body portion, the magnetic sleeve receiving recess being formed between the first and second body portions.

Embodiment 6

The control valve assembly according to claim 4, wherein the at least one wall portion includes a first wall portion defined by the first body portion and a second wall portion defined by the second body portion.

Embodiment 7

The control valve assembly according to claim 6, further comprising: a first spring arranged between the first wall portion and the first end portion of the magnetic sleeve and a second spring arranged between the second wall portion and the second end portion of the magnetic sleeve.

Embodiment 8

The control valve assembly according to claim 6, further comprising: a spring arranged about the second body portion between the first wall portion and the first end portion of the magnetic sleeve.

Embodiment 9

The control valve assembly according to claim 8, wherein the spring extends about the second body portion at the mud flow outlet.

Embodiment 10

The control valve assembly according to claim 1, wherein the magnetic sleeve is formed from 9Cr.

Embodiment 11

The control valve assembly according to claim 10 wherein the magnetic sleeve is formed from diamond coated 9Cr.

Embodiment 12

A resource exploration system comprising: an uphole system; and a downhole system including a downhole string operatively connected to the uphole system, the downhole string including a pulser alternator generator having a main valve assembly, an alternator, and a control valve assembly operatively connected to the main valve assembly and the alternator, the control valve assembly comprising: a body including a mud flow passage having a mud flow inlet fluidically connected to the main valve assembly and a mud flow outlet; a magnetic sleeve slidingly mounted to the body; and a solenoid mounted to the body adjacent the magnetic sleeve, the solenoid being selectively activated to shift the magnetic sleeve between a first position covering the mud flow outlet and a second position exposing the mud flow outlet allowing a pulse of mud to flow through the mud flow passage.

Embodiment 13

The control valve according to claim 12, wherein the magnetic sleeve includes an opening that selectively registers with the mud flow outlet in the second position.

Embodiment 14

The control valve according to claim 12, wherein the body includes a magnetic sleeve receiving recess including at least one wall portion, the magnetic sleeve including a first end portion, a second end portion and a blocking portion nesting within the magnetic sleeve receiving recess.

Embodiment 15

The control valve according to claim 14, further comprising: a spring arranged between the at least one wall portion and one of the first and second end portions of the magnetic sleeve.

Embodiment 16

The control valve according to claim 14, wherein the body includes a first body portion operatively coupled to a second body portion, the magnetic sleeve receiving recess being formed between the first and second body portions.

Embodiment 17

The control valve according to claim 16, wherein the at least one wall portion includes a first wall portion defined by the first body portion and a second wall portion defined by the second body portion.

Embodiment 18

The control valve according to claim 17, further comprising: a first spring arranged between the first wall portion and the first end portion of the magnetic sleeve and a second spring arranged between the second wall portion and the second end portion of the magnetic sleeve.

Embodiment 19

The control valve according to claim 17, further comprising: a spring arranged about the second body portion between the first wall portion and the first end portion of the magnetic sleeve.

Embodiment 20

The control valve according to claim 19, wherein the spring extends about the second body portion at the mud flow outlet.

Embodiment 21

The resource exploration system to claim 12, wherein the magnetic sleeve is formed from 9Cr.

Embodiment 22

The resource exploration system according to claim 21 wherein the magnetic sleeve is formed from diamond coated 9Cr.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A mud flow control valve assembly operatively connected to an uphole system comprising:

a body including a mud flow passage having a mud flow inlet and a mud flow outlet;

a magnetic sleeve slidingly mounted to the body, the magnetic sleeve defining an radially outermost portion of the body;

a spring in operable communication with the magnetic sleeve; and a solenoid mounted to the body adjacent the magnetic sleeve, the solenoid being selectively activated to repeatedly shift the magnetic sleeve between a first position covering the mud flow outlet and a second position exposing the mud flow outlet allowing a pulse of mud to flow through the mud flow passage, wherein the spring biases the magnetic sleeve back to the first position so as to create a pattern of mud flow pulses representing signals from a downhole device that are received by the uphole system.

2. The control valve assembly according to claim 1, wherein the magnetic sleeve includes an opening that selectively registers with the mud flow outlet in the second position.

3. The control valve assembly according to claim 1, wherein the body includes a magnetic sleeve receiving recess including at least one wall portion, the magnetic sleeve including a first end portion, a second end portion and a blocking portion nesting within the magnetic sleeve receiving recess.

4. The control valve assembly according to claim 3, wherein the spring arranged between the at least one wall portion and one of the first and second end portions of the magnetic sleeve.

5. The control valve assembly according to claim 3, wherein the body includes a first body portion operatively coupled to a second body portion, the magnetic sleeve receiving recess being formed between the first and second body portions.

6. The control valve assembly according to claim 4, wherein the at least one wall portion includes a first wall portion defined by the first body portion and a second wall portion defined by the second body portion.

7. The control valve assembly according to claim 6, wherein the spring includes a first spring arranged between the first wall portion and the first end portion of the magnetic sleeve and a second spring arranged between the second wall portion and the second end portion of the magnetic sleeve.

8. The control valve assembly according to claim 6, wherein the spring is arranged about the second body portion between the first wall portion and the first end portion of the magnetic sleeve.

9. The control valve assembly according to claim 8, wherein the spring extends about the second body portion at the mud flow outlet.

10. The control valve assembly according to claim 1, wherein the magnetic sleeve is formed from 9Cr.

11. The control valve assembly according to claim 10 wherein the magnetic sleeve is formed from diamond coated 9Cr.

12. A resource exploration system comprising:

an uphole system including a signal receiver; and a downhole system including a downhole string operatively connected to the uphole system, the downhole string including a sensor and a pulser alternator generator operatively connected to the sensor, the pulser alternator generator having a main valve assembly, an alternator, and a control valve assembly operatively connected to the main valve assembly and the alternator, the control valve assembly comprising:

a body including a mud flow passage having a mud flow inlet fluidically connected to the main valve assembly and a mud flow outlet;

a magnetic sleeve slidingly mounted to the body, the magnetic sleeve defining a radially outermost portion of the body;

a spring in operable communication with the magnetic sleeve; and a solenoid mounted to the body adjacent the magnetic sleeve, the solenoid being selectively activated to repeatedly shift the magnetic sleeve between a first position covering the mud flow outlet and a second position exposing the mud flow outlet allowing a pulse of mud to flow through the mud flow passage, wherein the spring biases the magnetic sleeve back to the first position so as to create a pattern of mud flow pulses.

13. The resource exploration system according to claim 12, wherein the magnetic sleeve includes an opening that selectively registers with the mud flow outlet in the second position.

14. The resource exploration system according to claim 12, wherein the body includes a magnetic sleeve receiving recess including at least one wall portion, the magnetic sleeve including a first end portion, a second end portion and a blocking portion nesting within the magnetic sleeve receiving recess.

15. The resource exploration system according to claim 14, wherein the spring arranged between the at least one wall portion and one of the first and second end portions of the magnetic sleeve.

16. The resource exploration system according to claim 14, wherein the body includes a first body portion operatively coupled to a second body portion, the magnetic sleeve receiving recess being formed between the first and second body portions.

17. The resource exploration system according to claim 16, wherein the at least one wall portion includes a first wall portion defined by the first body portion and a second wall portion defined by the second body portion.

18. The resource exploration system according to claim 17, wherein the spring comprises a first spring arranged between the first wall portion and the first end portion of the magnetic sleeve and a second spring arranged between the second wall portion and the second end portion of the magnetic sleeve.

19. The resource exploration system according to claim 17, wherein the spring is arranged about the second body portion between the first wall portion and the first end portion of the magnetic sleeve.

20. The resource exploration system according to claim 19, wherein the spring extends about the second body portion at the mud flow outlet.

21. The resource exploration system to claim 12, wherein the magnetic sleeve is formed from 9Cr.

22. The resource exploration system according to claim 21 wherein the magnetic sleeve is formed from diamond coated 9Cr.

* * * * *